US005829396A

United States Patent [19]

Sturman

[11] Patent Number: 5,829,396

[45] **Date of Patent: *Nov. 3, 1998**

[54] HYDRAULICALLY CONTROLLED INTAKE/ EXHAUST VALVE

[75] Inventor: Oded E. Sturman, Woodland Park, Colo.

[73] Assignee: Sturman Industries, Woodland Park, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 682,027

[22] Filed: Jul. 16, 1996

[51] Int. Cl.[6] ..... F01L 9/02

[52] U.S. Cl. ..... 123/90.12; 123/90.24; 123/90.28; 251/62; 251/63.4; 251/30.01; 251/129.1; 137/625.65

[58] Field of Search ..... 123/90.11, 90.12, 123/90.13, 90.24, 90.28; 251/62, 63.5, 63.4, 30.01, 129.1; 137/625.65

[56] References Cited

U.S. PATENT DOCUMENTS

| | | | |
|---|---|---|---|
| 3,727,595 | 4/1973 | Links | 123/90.12 |
| 4,041,983 | 8/1977 | Bianchetta | 137/625.66 |
| 4,309,966 | 1/1982 | Klomp | 123/90.28 |
| 4,795,130 | 1/1989 | Price et al. | 251/62 |
| 4,898,128 | 2/1990 | Meneely | 123/90.12 |
| 4,930,464 | 6/1990 | Letsche | 123/90.12 |
| 5,209,453 | 5/1993 | Aota et al. | 123/90.12 |
| 5,231,959 | 8/1993 | Smietana | 123/90.12 |
| 5,251,671 | 10/1993 | Hiroki | 137/625.65 |
| 5,284,220 | 2/1994 | Shimizu et al. | 137/625.65 |
| 5,509,383 | 4/1996 | Kahrs et al. | 123/90.17 |
| 5,531,192 | 7/1996 | Feucht et al. | 123/90.12 |
| 5,595,148 | 1/1997 | Letsche et al. | 123/90.12 |
| 5,640,987 | 6/1997 | Sturman | 137/625.65 |

FOREIGN PATENT DOCUMENTS

| | | | |
|---|---|---|---|
| 2209206 | 8/1973 | Germany | 251/129.1 |

*Primary Examiner*—Weilun Lo

*Attorney, Agent, or Firm*—Blakely Sokoloff Taylor & Zafman

[57] ABSTRACT

A camless valve assembly for an internal combustion engine which utilizes a plurality of three position control valves to open and close the intake and exhaust valves of the assembly. Each valve is coupled to a plurality of hydraulically driven pins that move the valve between the open and closed positions. The flow of fluid to the pins is controlled by the three position digitally latched solenoid actuated control valves that can be switched between a first position, a second position and a neutral position. When a control valve is in the first position the fluid flows into the pins and moves the valve. When the control valve is in the second position the fluid can flow away from the pins to allow the valve to move back to the original position. When the control valve is in the neutral position the fluid does not flow so that the valve cannot move. The control valve can be switched by a controller that can move and maintain a valve at any position during any cycle of the engine.

13 Claims, 3 Drawing Sheets

HYDRAULICALLY CONTROLLED INTAKE/ EXHAUST VALVE

BACKGROUND OF THE INVENTION

1. Field of the Invention

The present invention relates to a intake/exhaust valve assembly for an internal combustion engine.

2. Description of Related Art

Internal combustion engines contain an intake valve and an exhaust valve for each cylinder of the engine. In a compression ignition (CI) engine the intake valve allows air to flow into the combustion chamber and the exhaust valve allows the combusted air/fuel mixture to flow out of the chamber. The timing of the valves must correspond to the motion of the piston and the injection of fuel into the chamber. Conventional CI engines incorporate cams to coordinate the timing of the valves with the piston and the fuel injector. Cams are subject to wear which may affect the timing of the valves. Additionally, cams are not amenable to variations in the valve timing during the operation of the engine.

U.S. Pat. No. 5,125,370 issued to Kawamura; U.S. Pat. No. 4,715,330 issued to Buchl and U.S. Pat. No. 4,715,332 issued to Kreuter disclose intake valves that are controlled by solenoids. Each valve is moved between an open position and a closed position by energizing the solenoids. The amount of power required to actuate the solenoids and move the valves is relatively large. The additional power requirement reduces the energy efficiency of the engine.

U.S. Pat. Nos. 4,200,067 and 4,206,728 issued to Trenne; U.S. Pat. Nos. 5,248,123, 5,022,358 and 4,899,700 issued to Richeson; U.S. Pat. No. 4,791,895 issued to Tittizer; U.S. Pat. No. 5,237,968 issued to Miller et al. and U.S. Pat. No. 5,255,641 issued to Schechter all disclose hydraulically controlled intake valves. The hydraulic fluid is typically controlled by a solenoid control valve. The solenoid valves described and used in the prior art require a constant supply of power to maintain the valves in an actuating position. The continuous consumption of power reduces the energy efficiency of the engine. Additionally, the solenoid control valves of the prior art have been found to be relatively slow thus restricting the accuracy of the valve timing. It would therefore be desirable to provide a camless intake valve that was fast and energy efficient.

Some large diesel engines utilize a "Jake" brake technique for slowing down the vehicle when the engine is not providing fuel to the internal combustion chambers. A Jake brake maintains the intake and exhaust valves in the closed position during the compression stroke of the pistons. Near top dead center the exhaust valves are opened to release the air from the chamber so that the compressed air does not provide stored energy to return the piston to the bottom dead center position. The engine must thus work to continually compress the air within the internal combustion chambers. The additional work reduces the speed of the engine and the vehicle. Jake brakes typically include complex mechanisms that control the valves during the breaking process. It would be desirable to provide a simple valve assembly to Jake brake an engine.

SUMMARY OF THE INVENTION

The present invention is a camless valve assembly for an internal combustion engine which utilizes a plurality of three position control valves to open and close the intake and exhaust valves of the assembly. Each valve is coupled to a plurality of hydraulically driven pins that move the valve between the open and closed positions. The flow of fluid to the pins is controlled by the three position digitally latched solenoid actuated control valves that can be switched between a first position, a second position and a neutral position. When a control valve is in the first position the fluid flows into the pins and moves the valve. When the control valve is in the second position the fluid can flow away from the pins to allow the valve to move back to the original position. When the control valve is in the neutral position the fluid does not flow so that the valve cannot move. The control valve can be switched by a controller that can move and maintain a valve at any position during any cycle of the engine.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
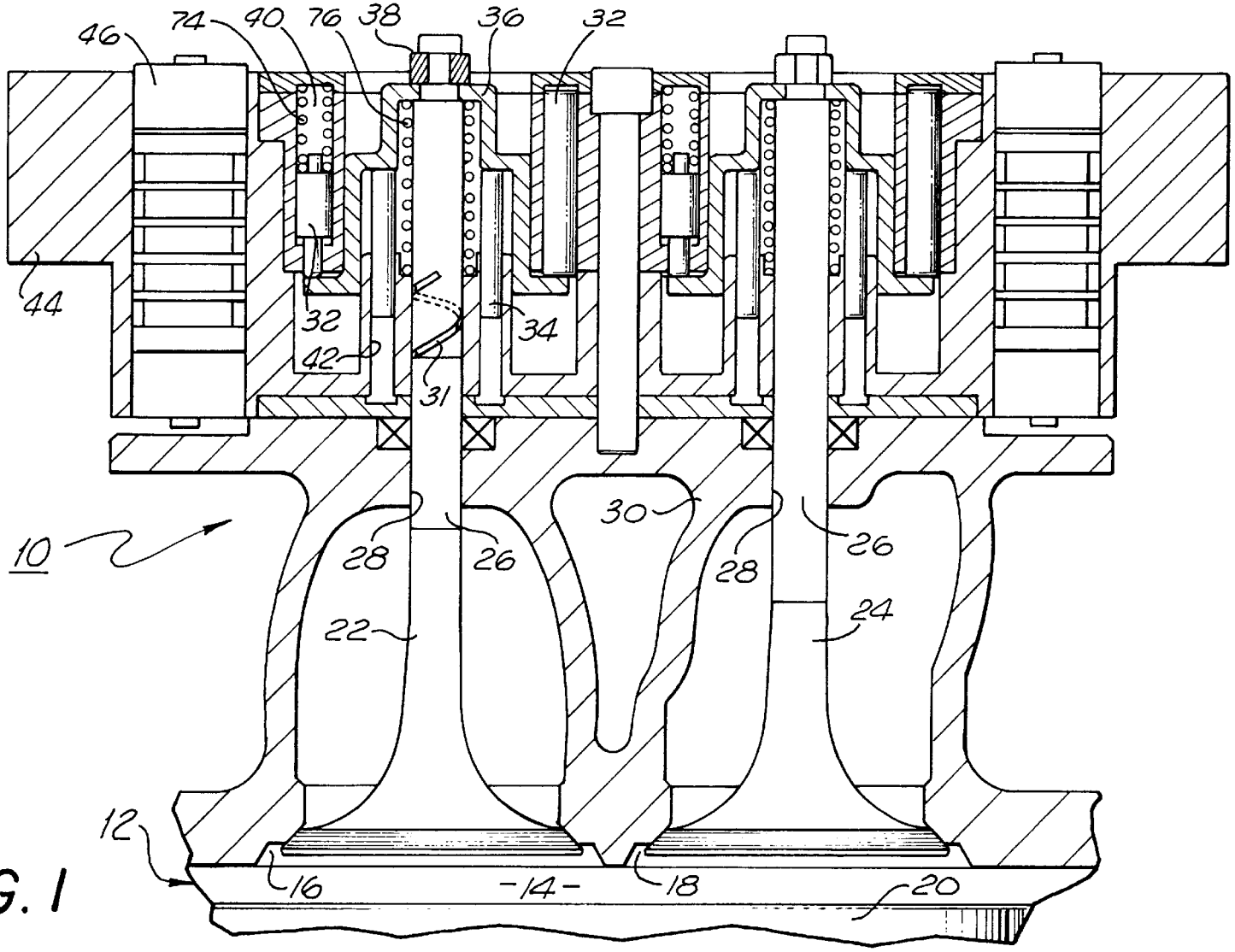
FIG. 1 is a cross-sectional view of a valve assembly of the present invention.

Referring to the drawings more particularly by reference numbers, FIG. 1 shows a valve assembly 10 for an internal combustion engine. The engine includes a block 12 which has an internal combustion chamber 14, an intake port 16 and an exhaust port 18. A piston 20 moves within the combustion chamber 14. It being understood that an engine typically contains a plurality of combustion chambers and associated valves and pistons.

The flow of air through the intake port 16 is controlled by an intake valve 22 that can move between an open position and a closed position. The flow of exhaust through the exhaust port 18 is controlled by an exhaust valve 24 that can move between an open position and a closed position. The valves 22 and 24 can also move to any intermediate position between the fully closed and fully opened positions. The intermediate positions are also considered open positions.

Each valve 22 and 24 has a stem 26 that extends through a bore 28 of a valve housing 30 that is attached to the block 12. The stem 26 and bore 28 of the valve housing 30 may have a corresponding thread 31 that rotates the valves each time a valve moves between the open and closed positions. Rotation of the valves reduces non-uniform wear on the valve seat. Alternatively, the assembly may include a cam or other means for rotating the valves when the valves move between the open and closed positions.

Each intake/exhaust valve 22 and 24 is coupled to a plurality of first pins 32 and a plurality of second pins 34 by a collar 36. The collars 36 may be attached to the valve stems 26 by clamps 38. The first pins 32 are located within a plurality of chambers 40 that contain a fluid. The second pins 34 are located within a plurality of chambers 42 that contain the fluid. The chambers 40 and 42 are defined by the valve housing 30 and a manifold housing 44. The fluid may be the fuel of the engine or a separate hydraulic fluid.

The flow of fluid into the chambers 40 and 42 is controlled by a number of three position control valves 46. The control valves 46 may include either a single four-way valve for each valve, or a pair of three-way valves for each valve. To open an intake/exhaust valve 22 or 24 the corresponding control valve 46 is switched to a first position to allow fluid to flow into the chambers 40 to push the first pins 32 and move the valve 22 or 24 to the open position. The intake/exhaust valves are closed by switching the control valve 46 to provide pressurized fluid to the second pins 34. The pin chambers 40 are vented to a drain port to allow fluid to flow out of the chambers 40.

Figure 2:
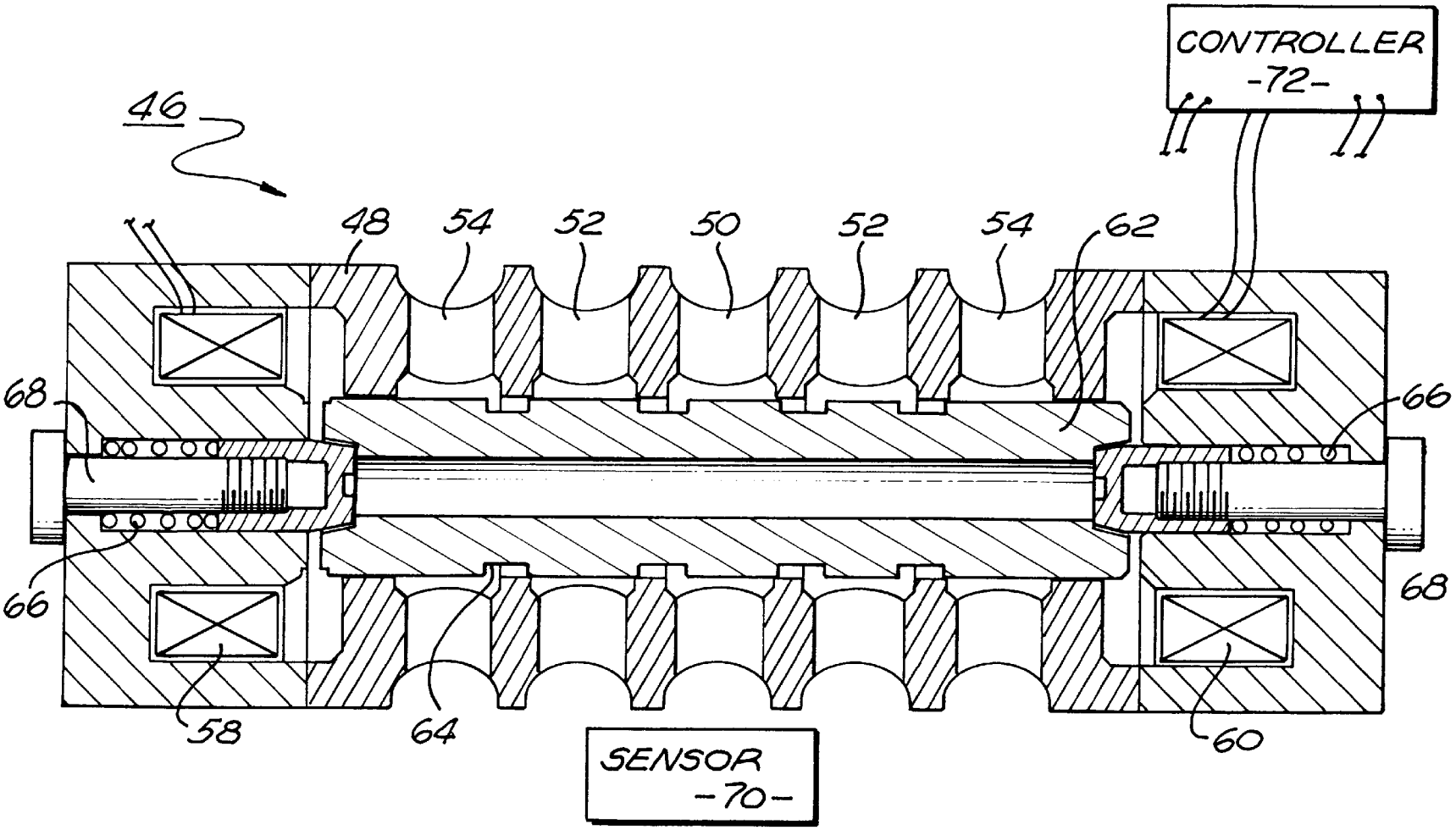
FIG. 2 is a cross sectional view of a three position control valve shown in a neutral position.

FIG. 2 shows a preferred embodiment of a three-way three-position control valve 46. The control valve 46 includes a housing 48 which has return port 50, a pair of cylinder ports 52, and a pair of supply ports 54. The return port 50 is typically connected to a drain line of the engine. The supply ports 54 are typically connected to a pressurized fluid line. The first cylinder port 52 may be connected to the first pin chamber 40 or the second pin chamber 42. A four-way valve would have an additional cylinder port that is connected to the other pin chamber.

The control valve 46 has a first solenoid 58 and a second solenoid 60 which move a spool 62 within the housing 48. The spool 62 has a number of grooves 64 which allow fluid communication between the various ports when the solenoids are actuated. The spool 62 is maintained in a neutral position by a pair of springs 66. In the neutral position the spool 62 does not allow fluid communication between any ports of the valve 46. Each spring 66 is captured by the housing 48 and a needle assembly 68.

Figure 3:
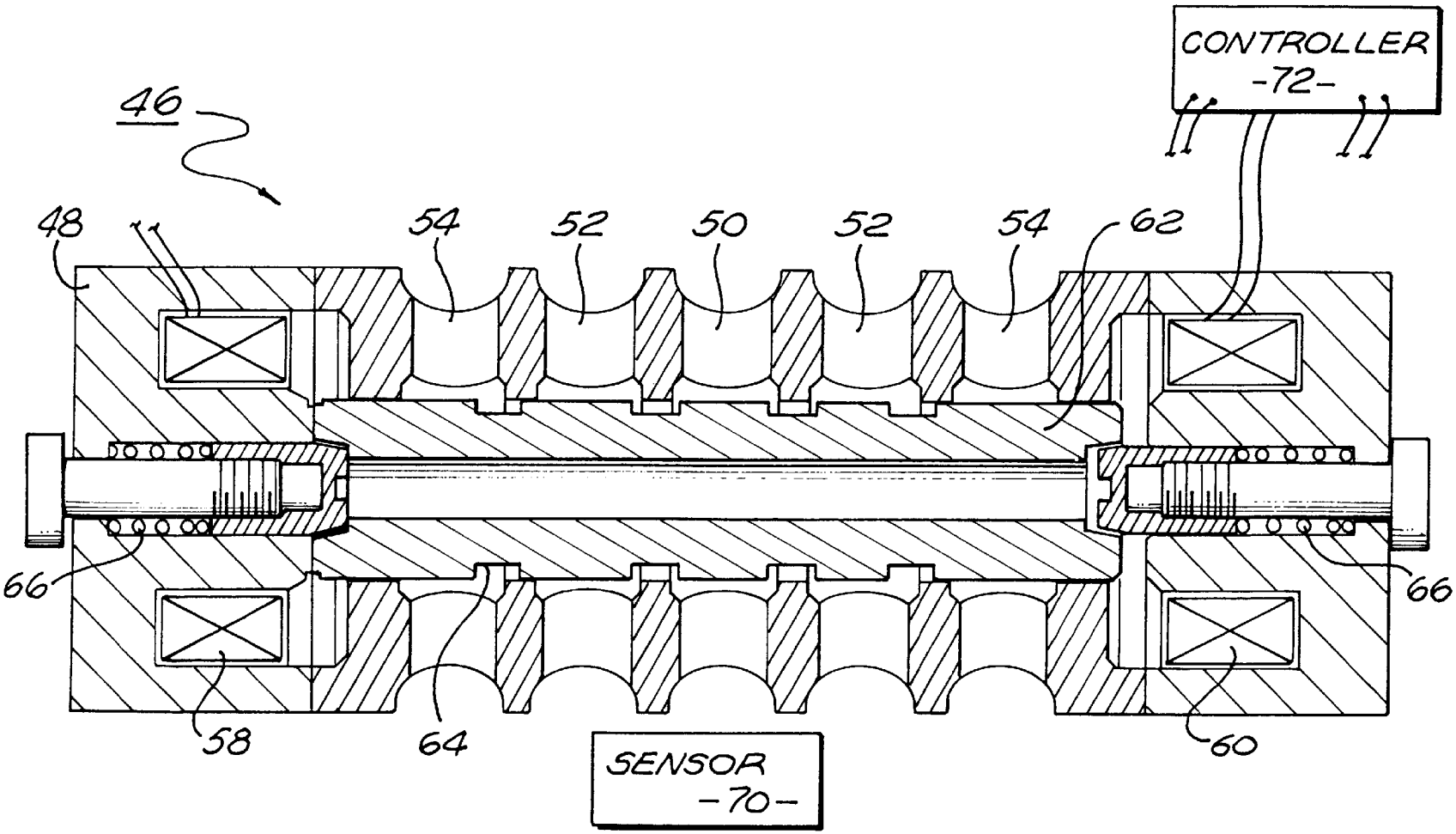
FIG. 3 is a cross-sectional view of the three position control valve shown in a first position.

As shown in FIG. 3, when the first solenoid 58 is actuated the spool 62 is moved to a first position. In the first position, the cylinder ports 52 are in fluid communication with the return port 50. When the second solenoid 60 is actuated the spool 62 is moved a second position. In the second position the cylinder ports 52 are in fluid communication with the supply port 54.

The spool 62 and housing 48 are preferably constructed from a material which has an hystersis that maintains the position of the spool 62 even when power to the solenoids is terminated. The material is preferably a 52100 or 440C steel. The magnetic steel material allows the spool to be latched into the first or second position by providing a digital pulse to the solenoids. The spool 62 can be returned to the neutral position by providing a short pulse on the opposite solenoid, or providing a voltage of opposite polarity to the solenoid adjacent to the latched spool 62 to detach the spool 62 from the housing 48. The detached spool 62 is biased into the neutral position by the springs 66. Alternatively, digital pulses may be provided to both solenoids to iteratively move the spool 62 to the neutral position. The control valve 46 may have a position sensor 70, such as a hall sensor to sense the position of the spool 62. The solenoids 58 and 60 are typically connected to a controller 72 that provides the digital pulses to the control valve 46.

In operation, to open an intake/exhaust valve 22 or 24, the controller 72 switches the corresponding control valve(s) 46 to the first position to allow fluid to flow into the first pin chambers 40 and push the first pins 32. The fluid within the second pin chambers 42 is allowed to flow into the drain line of the engine.

The first pin chambers 40 may contain booster springs 74 to provide an additional force to open the intake/exhaust valves. The springs 74 also dampen the movement of the valve back to the closed position to prevent striking and corresponding wear on the valve seat.

The position of the valve 22 or 24 can be maintained by switching the control valve 46 to the neutral position and preventing fluid flow within the pin chambers 40 and 42. By providing a neutral position, the time interval that the intake/exhaust valve is opened can be varied for different operating conditions of the engine. By way of example, the valve position can be varied to change the amount of air drawn into the combustion chamber and released from the chamber during a Jake brake cycle.

The intake/exhaust valve can then be closed by switching the control valve 46 to pressurize the chambers 42 and push the second pins 34. The assembly 10 may include return springs 76 that bias the valves to the closed position.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. For example, although a valve assembly with second pins 34 is shown and described, it is to be understood that the assembly may have a return spring (not shown) coupled to the intake/exhaust valves to return the valves to the closed position. In such a configuration the assembly preferably contains a single three-way control valve 46 for each intake/exhaust valve to switch the first pin chambers 40 between the supply and return ports of the control valve.

What is claimed is:

1. A valve assembly for an internal combustion engine, comprising:

a valve that moves between an open position and a closed position;

a first hydraulically driven pin operable to move said value to the open position;

a second hydraulically driven pin operable to move said valve to the closed position; and, a position control valve which controls said first and second hydraulically driven pins.

2. The valve assembly as recited in claim 1, wherein said position control valve includes a spool that is located within a housing and maintained in the neutral position by a pair of springs, said position control valve further including a first solenoid that pulls said spool to the first position and a second solenoid that pulls said spool to the second position.

3. The valve assembly as recited in claim 2, wherein said first and second solenoids are actuated by a digital pulse.

4. The valve assembly as recited in claim 1, further comprising a booster spring that is coupled to said first pin to bias said valve to the open position.

5. The valve assembly as recited in claim 1, wherein said position control valve is a three-way valve.

6. The valve assembly as recited in claim 1, wherein said control valve includes a neutral position which maintains said valve in an intermediate position between said open and closed positions.

7. The valve assembly as recited in claim 6, further comprising a collar that couples said first pin and said second pin to said valve.

8. An internal combustion engine, comprising:

a block that has an internal combustion chamber, an exhaust port and an intake port;

a valve housing that is attached to said block;

an intake valve that is coupled to said valve housing and which can move between an open position and a closed position to control a flow of air through said intake port;

an exhaust valve that is coupled to said valve housing and which can move between an open position, a closed position and an intermediate position to control a flow of exhaust through said exhaust port;

a first intake pin that is in fluid communication with a fluid that moves said intake valve to the open position;

a first exhaust pin that is in fluid communication with the fluid to move said exhaust valve to the open position;

a three position intake control valve which controls the movement of said first intake pin, wherein said three position intake control valve includes a first position which allows the fluid to flow to said first intake pin, a second position which allows fluid to flow from said first intake pin and a neutral position which does not allow fluid flow and maintains said intake valve in said intermediate position;

a three position exhaust control valve which controls the movement of said first exhaust pin, wherein said three position exhaust control valve includes a first position which allows the fluid to flow to said first exhaust pin, a second position which allows fluid to flow from said first exhaust pin and a neutral position which does not allow fluid flow and maintains said exhaust valve in said intermediate positions a second intake pin that is in fluid communication with the fluid and which moves said intake valve to the closed position when said three position intake control valve is in the second position; and, a second exhaust pin that is in fluid communication with the fluid and which moves said exhaust valve to the closed position when said three position exhaust control valve is in the second position.

9. The engine as recited in claim 8, wherein said three position intake and exhaust control valves each include a spool that is located within a housing and maintained in the neutral position by a pair of springs, said three position intake and exhaust control valves further including a first solenoid that pulls said spool to the first position and a second solenoid that pulls said spool to the second position.

10. The engine as recited in claim 9, wherein said first and second solenoids are actuated by a digital pulse.

11. The engine as recited in claim 8, wherein said three position intake and exhaust control valves are each a three-way valve.

12. The valve assembly as recited in claim 8, further comprising a pair of booster springs that are coupled to said first intake and exhaust pins to bias said intake and exhaust valves to the open positions.

13. The valve assembly as recited in claim 8, further comprising a pair of collars that couple said first and second intake and exhaust pins to said intake and exhaust valves.

* * * * *

UNITED STATES PATENT AND TRADEMARK OFFICE

Certificate

Patent No. 5,829,396

Patented: November 3, 1998

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Oded E. Sturman; Steven Massey, both of Woodland Park, Co.

Signed and Sealed this Fifteenth Day of February, 2000.

THOMAS E. DENION
*Supervisory Patent Examiner*
Art Unit 3748